US011677169B2

(12) United States Patent
Zucca et al.

(10) Patent No.: US 11,677,169 B2
(45) Date of Patent: Jun. 13, 2023

(54) INSULATION DISPLACEMENT CONTACT AND INSULATION DISPLACEMENT CONTACT ASSEMBLY FOR HIGH PERFORMANCE ELECTRICAL CONNECTIONS

(71) Applicants: TE Connectivity Nederland BV, s'Hertogenbosch (NL); Tyco Electronics UK Ltd., Wiltshire (GB)

(72) Inventors: Marco Zucca, s-Hertogenbosch (NL); Subhash Mungarwadi, Hungerford (GB); Olaf Leijnse, Asten (NL)

(73) Assignees: TE Connectivity Nederland BV, S-Hertogenbosch (NL); Tyco Electronics UK Ltd., Wiltshire (GB)

( * ) Notice: Subject to any disclaimer, the term of this patent is extended or adjusted under 35 U.S.C. 154(b) by 0 days.

(21) Appl. No.: 17/323,435

(22) Filed: May 18, 2021

(65) Prior Publication Data

US 2021/0273350 A1 Sep. 2, 2021

Related U.S. Application Data

(63) Continuation of application No. PCT/EP2019/081694, filed on Nov. 18, 2019.

(30) Foreign Application Priority Data

Nov. 19, 2018 (EP) ..... 18207098

(51) Int. Cl.
*H01R 4/2445* (2018.01)

(52) U.S. Cl.
CPC ..... *H01R 4/2445* (2013.01)

(58) Field of Classification Search
CPC ..... H01R 4/2445; H01R 13/15; H01R 4/242
See application file for complete search history.

(56) References Cited

U.S. PATENT DOCUMENTS 4,192,570 A * 3/1980 Van Horn ..... H01R 4/245 439/402
4,749,366 A 6/1988 McCaffery
(Continued)

FOREIGN PATENT DOCUMENTS

CN 1047590 A 12/1990
CN 204835017 U 12/2015
(Continued)

OTHER PUBLICATIONS

PCT International Search Report and Written Opinion, dated Feb. 11, 2020, 12 pages.
(Continued)

*Primary Examiner* — Jean F Duverne
(74) *Attorney, Agent, or Firm* — Barley Synder

(57) ABSTRACT

An insulation displacement contact is for piercing through an insulation of a cable or wire in a cutting direction and electrically contacting an electrically conductive core of the cable or wire. The insulation displacement contact includes a contact body having a piercing section for piercing the insulation and a contact slot receiving the core of the cable or wire. The contact slot extends along the cutting direction from the piercing section into the contact body. The contact body has a pair of blades separated by the contact slot. The blades have a pair of attachment slots extending from the piercing section into the blades.

15 Claims, 12 Drawing Sheets

(56) References Cited

U.S. PATENT DOCUMENTS

| | | | | |
|---|---|---|---|---|
| 5,120,235 | A | 6/1992 | Kashiwa | |
| 6,776,647 | B1 | 8/2004 | Herrmann et al. | |
| 9,705,209 | B2 * | 7/2017 | Sabo | H01R 4/2425 |
| 10,050,395 | B2 * | 8/2018 | Ngo | H01R 13/6275 |
| 10,541,478 | B1 * | 1/2020 | King, Jr. | H01R 43/01 |
| 2001/0039139 | A1 | 11/2001 | Herrmann et al. | |
| 2003/0102873 | A1 | 6/2003 | Aekins et al. | |
| 2015/0194742 | A1 * | 7/2015 | Shigezane | H01R 13/501 439/395 |

FOREIGN PATENT DOCUMENTS

| | | | | |
|---|---|---|---|---|
| DE | 19736119 | A1 | | 3/1999 |
| DE | 19921768 | A1 | | 11/2000 |
| WO | 2010029392 | A1 | | 3/2010 |
| WO | 2014032123 | | * | 6/2014 |

OTHER PUBLICATIONS

First Office Action from the National Intellectual Property Administration of China dated Nov. 28, 2022, corresponding to Application No. 201980075648.6 with English translation, 17 pages.

* cited by examiner

INSULATION DISPLACEMENT CONTACT AND INSULATION DISPLACEMENT CONTACT ASSEMBLY FOR HIGH PERFORMANCE ELECTRICAL CONNECTIONS

CROSS-REFERENCE TO RELATED APPLICATIONS

This application is a continuation of PCT International Application No. PCT/EP2019/081694, filed on Nov. 18, 2019, which claims priority under 35 U.S.C. § 119 to European Patent Application No. 18207098.7, filed on Nov. 19, 2018.

FIELD OF THE INVENTION

The present invention relates to a contact and, more particularly, to an insulation displacement contact.

BACKGROUND

Insulation displacement contacts (IDCs) and IDC assemblies are known from the art. The prior art solutions, however, have the disadvantage that only a limited normal force may be exerted on an electrically conductive core of a cable or wire to which the IDC is attached. In higher current applications, in particular, an insufficient contact force may decrease the quality of the electric connection and may ultimately result in a temperature rise beyond the specifications of the assembly or even in the destruction of the entire assembly. Further, mechanical disturbances (e.g. vibrations) may result in a gradual decrease in the quality of the electrical connection in an IDC.

SUMMARY

An insulation displacement contact is for piercing through an insulation of a cable or wire in a cutting direction and electrically contacting an electrically conductive core of the cable or wire. The insulation displacement contact includes a contact body having a piercing section for piercing the insulation and a contact slot receiving the core of the cable or wire. The contact slot extends along the cutting direction from the piercing section into the contact body. The contact body has a pair of blades separated by the contact slot. The blades have a pair of attachment slots extending from the piercing section into the blades.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
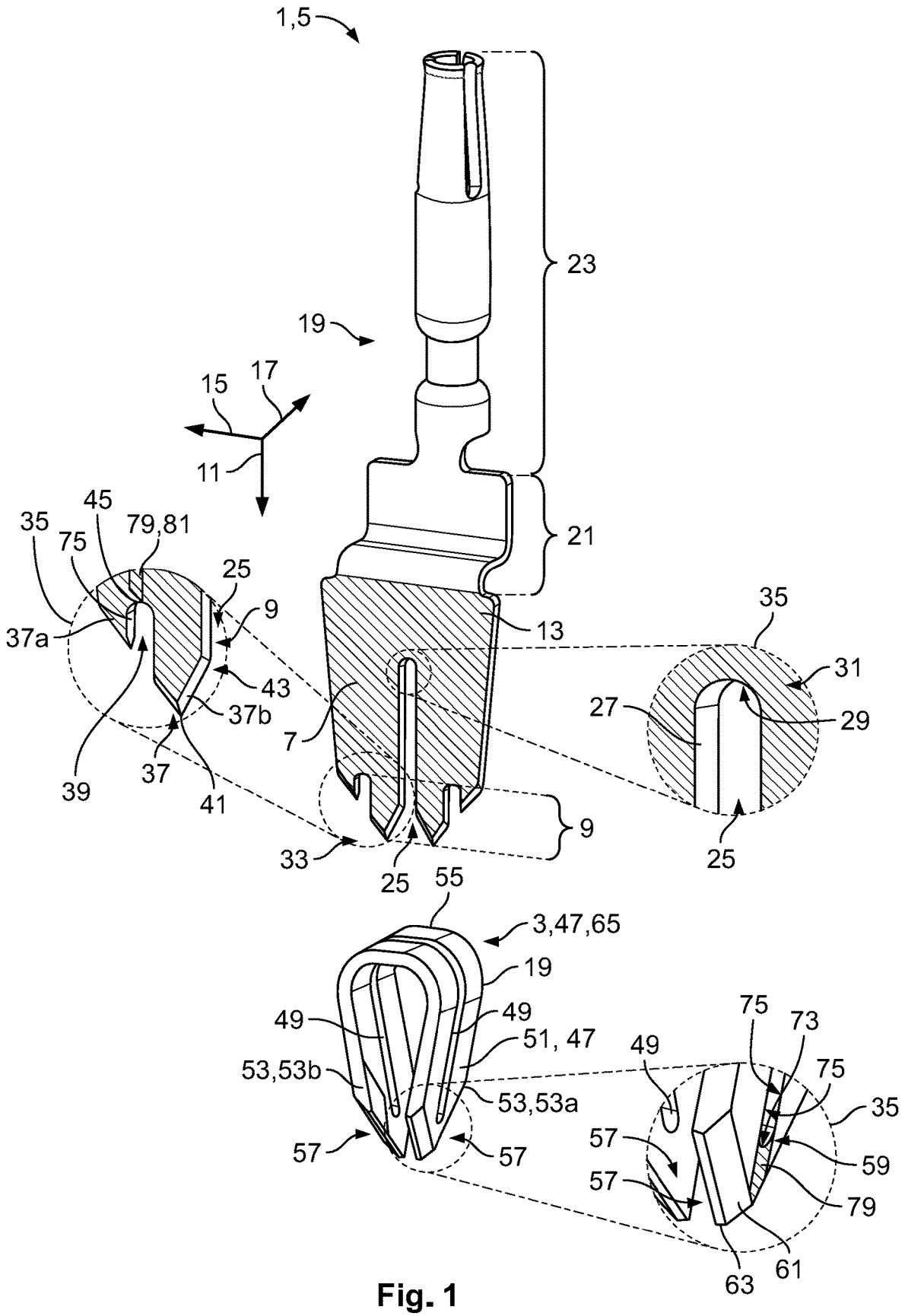
FIG. 1 is a sectional perspective view of an IDC and a clip according to a first embodiment.

In the following, the present invention will be described using the accompanying figures. The figures show embodiments of the present invention, each of which is advantageous on its own. Technical features of the following embodiments may be arbitrarily combined or even omitted if the technical effect obtained by the omitted technical feature is not relevant to the present invention. Identical technical features or technical features having the same technical function will be denoted using the same reference numeral. A repetitive description of technical features that appear in different figures will be omitted; differences between the figures will be explained. The embodiments of the present invention described herein are not intended to limit the scope of protection, which is defined by the accompanying claims.

FIG. 1 shows an insulation displacement contact 1 (referred to henceforth as IDC 1) and a clip 3. The IDC 1 is in an unassembled state 5. The IDC 1 comprises a contact body 7 with a piercing section 9. The IDC 1 extends essentially along a cutting direction 11.

As shown in FIG. 1, the contact body 7 is positioned in a contact plane 13 which is spanned by the cutting direction 11 and a width direction 15 oriented perpendicular to the cutting direction 11. The contact plane 13 is indicated by shading. A depth direction 17 is oriented perpendicularly to both the cutting direction 11 and the width direction 15.

The IDC 1 is a bent and stamped sheet-metal part 19 in which the contact body 7 is monolithically connected to a transition section 21, which in turn is monolithically connected to a cable crimp connector section 23 formed as a receiving barrel for receiving a connector cable. It is to be noted that numerous embodiments of transition sections 21 and/or cable crimp connector sections 23 are conceivable (see e.g. FIG. 2). The shown embodiment of the transition section 21 and the cable crimp connector section 23 are purely exemplary.

Further, the depicted IDC 1 is adapted to provide an electrical connection between a cable mechanically and electrically connected to the cable crimp connector section 23 with another cable, which is contacted via the piercing section 9 of the contact body 7. The shown embodiment is not intended to limit the scope of protection, as different configurations and/or connection schemes of one, two or more contact bodies 7 are conceivable.

The IDC 1, as shown in FIG. 1, has a contact slot 25 which is oriented parallel to the cutting direction 11 and which extends in a direction counter to the cutting direction 11 from the piercing section 9 into the contact body 7. The contact slot 25 is positioned centrally in the contact body 7 and opens in the cutting direction 11. The contact slot 25 has an inner contact slot wall 27 with a contact slot bottom 29 at an end 31 of the contact slot 25 opposite a front end 33 of the IDC, where the contact slot 25 opens in cutting direction 11, i.e. is accessible from a direction counter to the cutting direction 11. This is shown in an enlarged detail view 35 of FIG. 1.

The piercing section 9 comprises two blades 37, one of which is shown in another enlarged detail view 35 in FIG. 1. The contact slot 25 may be centered between the two blades 37 and may be understood to be an elongated through-hole provided in the contact body 7 of the IDC 1. The blades 37 are separated by the contact slot 25 in the width direction 15. The blade 37 is not continuous but comprises a first blade section 37*a* and a second, V-shaped blade section 37*b*. An attachment slot 39 extends from the piercing section 9 into the blade 37 separating the first blade section 37*a* and the second blade section 37*b*. The second blade section 37*b* has a blade tip 41 away from which the blade 37 is inclined, i.e. counter to the cutting direction 11. On one side, the inclined second blade section 37*b* ends at an opening 43 of the contact slot 25. Such an inclination is advantageous for centering the core of a wire or cable for moving said core towards, and positioning it within, the contact slot 25. Each of the two blades 37 has an attachment slot 39, as shown in FIG. 1, wherein the second blade is embodied analogously to the shown blade 37. The blades 37 of the IDC 1 may be inclined towards each other in order to provide a two-dimensional funnel-like structure which centers the cable or wire which is to be contacted. In general, the cable or wire is oriented perpendicular to the contact body 7 and the blades 37 prior and during contacting.

As shown in FIG. 1, the attachment slots 39 extend along the cutting direction 11 and are oriented parallel to the contact slot 25. The attachment slots 39 open in the cutting direction 11 and end in an attachment slot bottom 45. The attachment slots 39 are adapted to receive the inventive clip 3. The IDC 1 is generally embodied as a flat and elongated structure, wherein a longest extension of the IDC 1 is generally oriented along the cutting direction 11. The blades 37, which are applied for piercing the insulation of a wire or cable, are usually embodied at the end of the IDC 1 facing in cutting direction 11. The attachment slots 39 are accessible from a direction opposite the cutting direction 11.

As shown in FIG. 1, the clip 3 has a U-shape 47 and may also be made of a stamped and bent sheet-metal part 19, wherein the clip 3 is bent around the depth direction 17, i.e. a wall 51 of the clip 3 is oriented perpendicular to the contact plane 13. A curved or non-curved surface of the sheet metal 19 of the clip may be oriented perpendicular to the contact body 7 of the IDC 1. The clip 3 has a mounting slot 49 which is embodied in the wall 51 and which thus also has a U-shape 47. The mounting slot 49 of the embodiment of the clip 3 shown in FIG. 1 extends from a first clip leg 53*a* to a clip base 55 and to a second clip leg 53*b*. The U-shape 47 may help to ensure the flexibility of the clip 3 so that the quality of the electrical connection can be maintained. The clip base 55 and the clip legs 53 may be formed monolithically.

If the U-shaped clip 3 is received via the attachment slots 39 of the contact body 7, the engagement described above is present for both blades 37. The U-shape 47 is to be understood as a form or shape in which the first sheet metal of the clip leg 53*a* extends from the blade 37 in a direction counter to the cutting direction 11, bends into the clip base 55 and subsequently bends further until it extends into the cutting direction 11, forming a second leg 53*b* of the clip 3 that extends towards the second blade 37. It is noted that the wording "bends" is to be understood as describing an as-is-state of the clip 3 and its geometrical contour and shape.

Each of the clip legs 53, i.e. the first clip leg 53*a* and the second clip leg 53*b*, extend from the clip base 55 in the cutting direction 11 towards a free end 57, where one of the free ends 57 is shown in another enlarged detail view 35 in FIG. 1. The free end 57 has an attachment section 59, a V-shaped clip blade 61 at each of the free ends 57 of the clip legs 53, and a leg tip 63, which is the foremost part of the clip 3 in the cutting direction 11. The clip blades 61 are oriented perpendicular to the blades 37 of the piercing section 9. In FIG. 1, the clip 3 is in a relaxed state 65.

Figure 2:
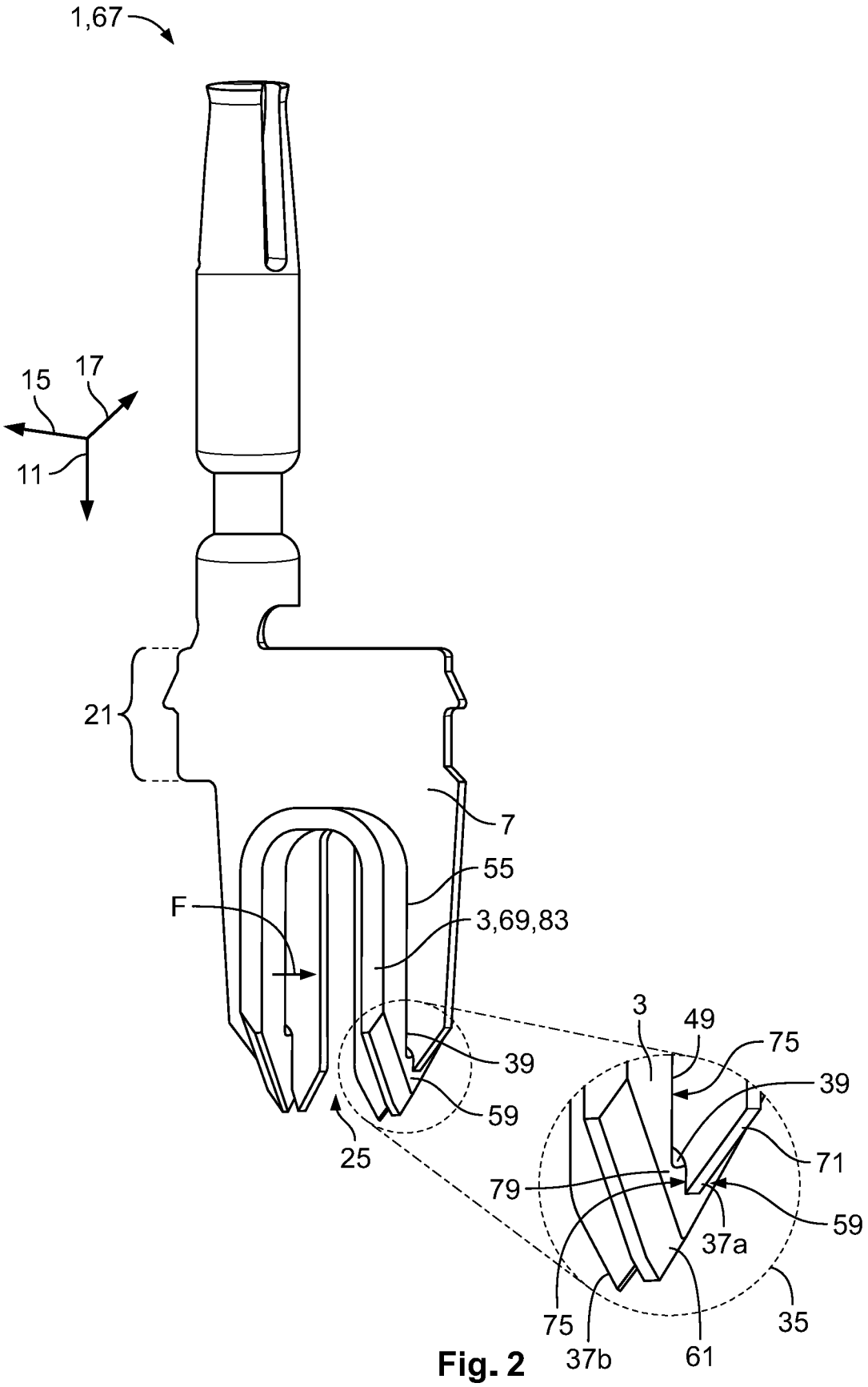
FIG. 2 is a perspective view of an IDC and a clip according to a second embodiment in an assembled state.

FIG. 2 shows a second embodiment of the inventive IDC 1 in an assembled state 67, i.e. the clip 3 is in an attached state 69, in which the clip 3 is attached to the contact body 7. The second embodiment of the IDC 1 differs from the first embodiment shown in FIG. 1 only in the transition section 21. The contact body 7 may be inserted into the mounting slot 49 when the clip 3 is in the attached state 69.

In the assembled state 67, the attachment sections 59 of the clip 3 are inserted in the corresponding attachment slots 39 of the blades 37 shown in the enlarged detail view 35 in FIG. 2. In an embodiment, the attachment section 59 is received within the attachment slots 39 forming an interference fit 71. In a different embodiment of the inventive IDC 1, both elements 39, 59 may engage with one another in a friction fit or positive fit.

The attachment section 59 is to be understood as a section which is embodied essentially complementarily to the corresponding attachment slot 39. The attachment section 59 may therefore be a portion of the clip 3 having a thickness in a direction perpendicular to the cutting direction 11 and within the plane of the contact body 7, which thickness is on the order of the width of the attachment slot 39 measured in the same direction. In further embodiments, the attachment slot 39 may have an inner contour, e.g. may be tapered. In such cases, the attachment section 59 of the clip 3 may be embodied complementarily, i.e. be provided with a beveled outer shape that fits into the attachment slot 39.

In the assembled state 67, the contact body 7 is inserted into the mounting slot 49 of the clip 3, such that the mounting slot 49 surrounds the contact slot 25. The attachment sections 59 extend along the cutting direction 11 to the at least one mounting slot 49. Thus, the mounting slot 49 borders, i.e. is positioned in the vicinity of, the corresponding attachment slot 39. The mounting slot 49 may therefore be understood to constitute a slot adapted to receive the contact body 7 which, in addition to inserting the clip 3 into the attachment slots 39, may attach the clip 3 to the contact body 7 and fix the position and/or orientation of the contact body 7 and a separate clip relative to one another. The mounting slot 49, in an embodiment, is in a center of the clip 3 and adapted to receive the entire contact body 7. The contact body 7 and/or the clip 3 may comprise stop members, which limit the insertion of the contact body 7 into the mounting slot 49. The mounting slot 49 may, in another embodiment, be shorter than a width of the contact body 7, the width being measured in a direction perpendicular to the cutting direction 11 in the plane of the contact body 7.

The attachment section 59 may thus be connected with the mounting slot 49, i.e. form one uninterrupted slot. This slot may extend from an end of the first clip leg 53*a* against the cutting direction 11 away from the blades 37. The thus formed mounting slot 49 merges into a curved progression which is located further away from the blades 37 than the contact slot 25. The mounting slot 49 passes the contact slot 25 and subsequently merges into the attachment section 59 of the second blade 37. Also the attachment section 59 of the second blade 37 extends parallel to the cutting direction 11 towards the end of the second blade 37.

Both the clip leg 53 and the blade 37 of the contact body 7 are to be understood as having a flat structure. Then the elements, i.e. the blade 37 or the clip leg 53, are rotated with respect to each other around a rotational axis positioned in the center of one slot 25, 39, wherein the rotational axis being oriented along the extension of the slot. If both elements are rotated by an angle of 90° to one another, the blade 37 and the clip 3 may be linearly moved towards each other along the extension of the slots 25, 39 such that the slots 25, 39 overlap.

The position of the clip 3 with respect to the contact body 7 in combination with the connection of the clip leg 53 and the blade 37, which are oriented perpendicular to one another, and stuck into each other may result in a particularly reliable and rigid attachment of the clip 3 to the contact body 7.

In the assembled state 69, the attachment slot bottom 45 (see enlarged detail view 35 to the left of FIG. 1) abuts a mounting slot bottom 73 (see enlarged detail view 35 at the bottom of FIG. 1). Further, inner walls 75 of the attachment slot 39 abut outer surfaces 79 of the attachment section 59, which outer surfaces 79 are indicated by shading in FIG. 1. In addition, inner walls 75 of the mounting slot 49 abut outer surfaces 79 of the piercing section 9, i.e the opposite inner walls 75 of the mounting slot 49 are supported by a face 81 of the blades 37. As most of the above technical features are not clearly visible in the assembled state 67, reference is made to the enlarged detail views 35 of FIG. 1.

FIG. 2 further shows that, in the attached state 69 of the clip 3, and in a projection along a direction oriented normal to the contact body 7, i.e. in a projection in the depth direction 17, the contact body 7 extends beyond the clip 3 in a direction perpendicular to the cutting direction 11, i.e. in and against the width direction 15 and in a direction counter to the cutting direction 11. The clip 3 is therefore positioned at a distance from the bordering edge of the contact body 7. Hence, the clip 3 does not encircle or surround the contact body 7.

In the embodiment shown, the clip blade 61 extends slightly beyond the first blade section 37*a* and the second blade section 37*b*, wherein in different embodiments, the clip blade 61 and blade sections 37*a* and 37*b* may be flush, or the clip blade 61 may be positioned further in the direction counter to the cutting direction 11, i.e. may be entirely received within the attachment slot 39. In a further embodiment of the IDC 1, the clip 3 may comprise at least one mounting slot 49, wherein in the attached state 69 of the clip 1, at least portions of the at least one slot 49 are oriented essentially perpendicular to the cutting direction 11.

In the attached state 69 of the clip 3, the clip 3 (in particular when compared to the relaxed state 65 shown in FIG. 1) is in a pre-tensioned state 83 in which the clip 3 exerts a force F on the piercing section 9 towards the contact slot 25. The force F is exerted symmetrically towards the contact slot 25. For the sake of visibility, only one arrow indicating the force F is shown in FIG. 2.

Figure 3:
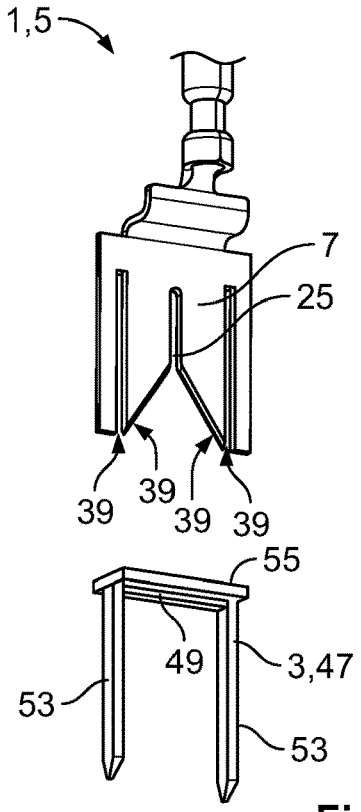
FIG. 3 is a perspective view of an IDC and a clip according to a third embodiment.

FIG. 3 shows a third embodiment of the inventive IDC 1 in the unassembled state 5 with a second embodiment of the clip 3. The clip 3 also has a U-shape 47 but is not adapted to exert a force F. Compared to the first and second embodiments of the IDC 1, the IDC 1 of FIG. 3 comprises longer attachment slots 39 due to the fact that the mounting slot 49 of the clip 3 only extends as far as the clip base 55.

Figure 4:
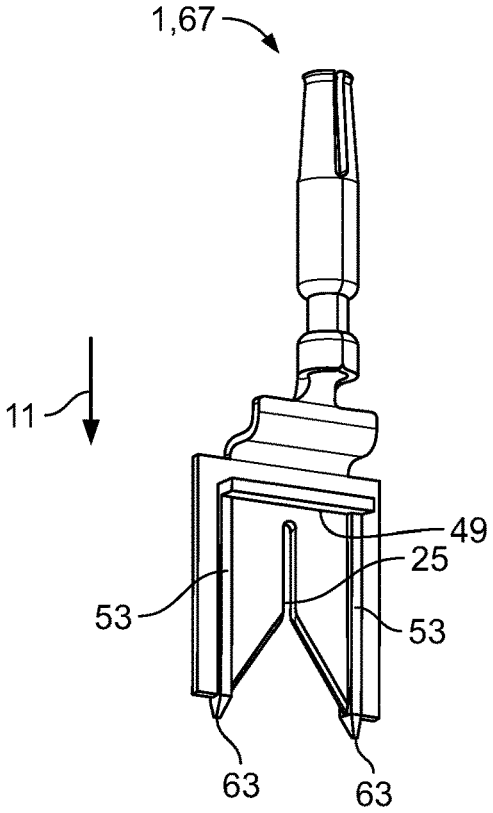
FIG. 4 is a perspective view of the IDC and the clip of FIG. 3 in an assembled state.

In the assembled state 67 of the IDC 1 of FIG. 3 shown in FIG. 4, most parts of the clip legs 53 are received within the attachment slots 39. Further, the blades 39 are only inclined towards the contact slot 25. As can be seen in FIG. 4, the leg tips 63 constitute, as shown in cutting direction 11, the foremost parts of the IDC 1 in the assembled state 67. The mounting slot 49 is oriented perpendicular to the contact slot 25 in the assembled state 67, whereby this is only partially the case in the first embodiment of the clip 3 shown in FIG. 2.

In the following, embodiments and details of an insulation displacement contact assembly 85 (abbreviated henceforth to IDC assembly 85), will be described with reference to the accompanying FIGS. 5 to 10.

Figure 5:
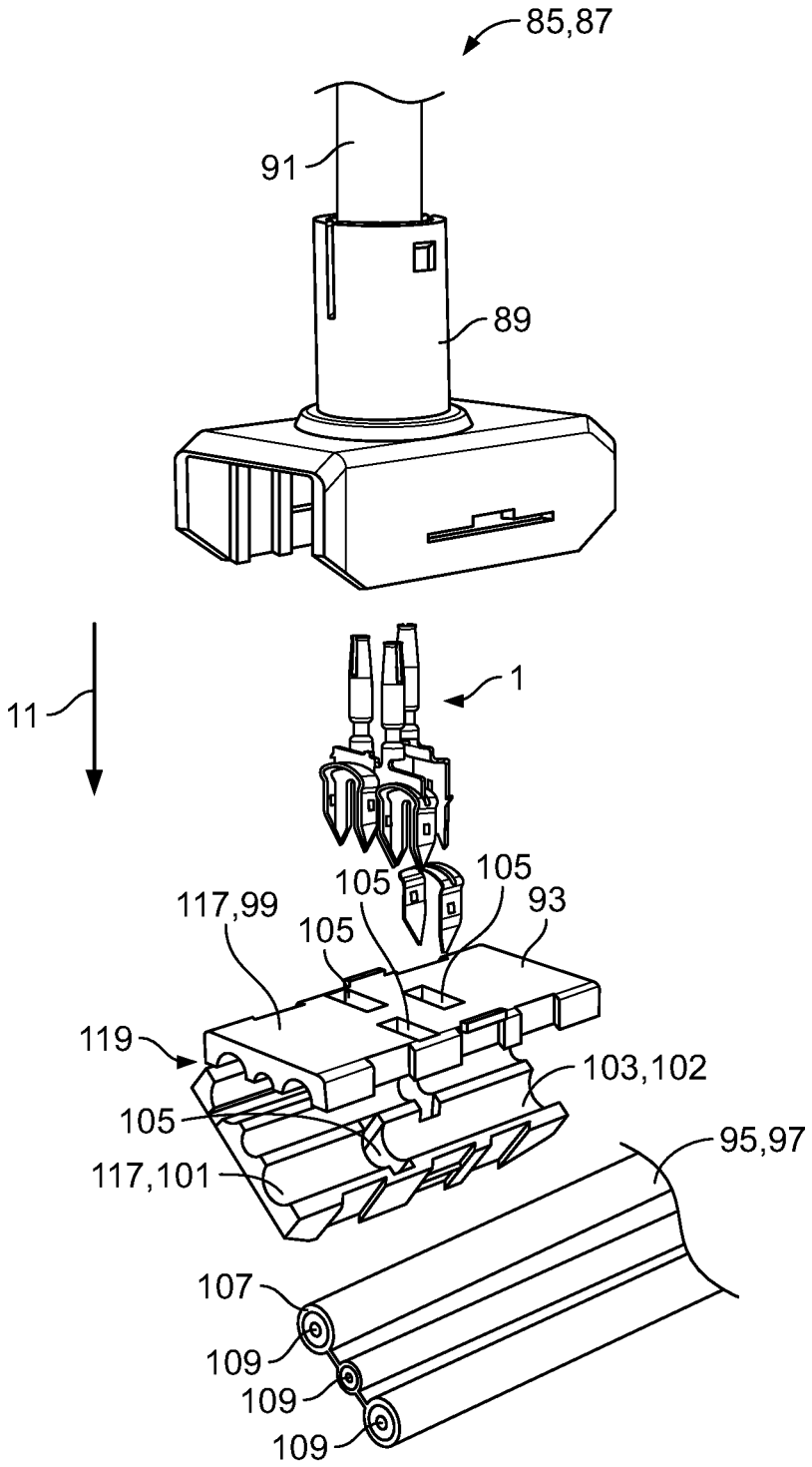
FIG. 5 is an exploded perspective view of an IDC assembly according to an embodiment.

FIG. 5 shows an exploded view 87 of the inventive IDC assembly 85. The IDC assembly 85 comprises a housing 89 for receiving at least one cable or wire 91, a plurality of IDCs 1, which may be received in the housing 89, and a cable positioner 93 which is adapted to receive and position at least one further cable or wire 95. The housing 89 and cable positioner 93 may be fabricated by injection molding in an embodiment. The housing 89 and the cable positioner 93 may be separate parts or may be connected to each other by a hinge structure. The cable positioner 93 is to be understood to constitute a cage-like structure in which further cables or wires are received and, due to the internal structure of the cable positioner 93, positioned correctly for further processing, e.g. piercing by an IDC 1.

The further cable or wire 95 is embodied as a ribbon cable 97, which is received in between an upper jaw 99 and a lower jaw 101 of the cable positioner 93 shown in FIG. 5. The position of the further cable or wire 95 is determined by cable receptacles 102 embodied as convex receiving slots 103, each of which comprises recesses 105 in the upper jaw 99 and the lower jaw 101, through which recesses 105 the IDCs 1 may be pushed in order to pierce an insulation 107 of the further cable or wire 95 and to electrically contact the electrically conductive core 109 of the further cable or wire 95.

The upper jaw 99 and the lower jaw 101 are two receiving parts 117 which are connected to one another by a hinge member 119, as shown in FIG. 5. The receiving parts 117 may be locked to each other and the cable positioner 93 may also comprise locking features for locking the cable positioner 93 at least two positions in the housing 89. The functionality is not discussed in further detail here.

After receiving the further cable or wire 95 within the jaws 99, 101 of the cable positioner 93, the cable positioner 93 is moved into the housing 89 along a direction counter to the cutting direction 11, thereby pushing the IDCs 1, which are fixed in the housing 89, through the recesses 105, piercing the insulation 107 of the further cable or wire 95 and electrically contacting the cores 109 of the further cables or wires 95. In an embodiment, the two clip legs 53 are convexly curved away from the contact slot 25. Such an embodiment may be advantageous because the convexly curved clip legs 53 may at least partially surround the cable insulation 107 after piercing, thereby holding the cable or wire 91 in place and further fixing its position with respect to the IDC 1 or the IDC assembly 85.

Figure 11:
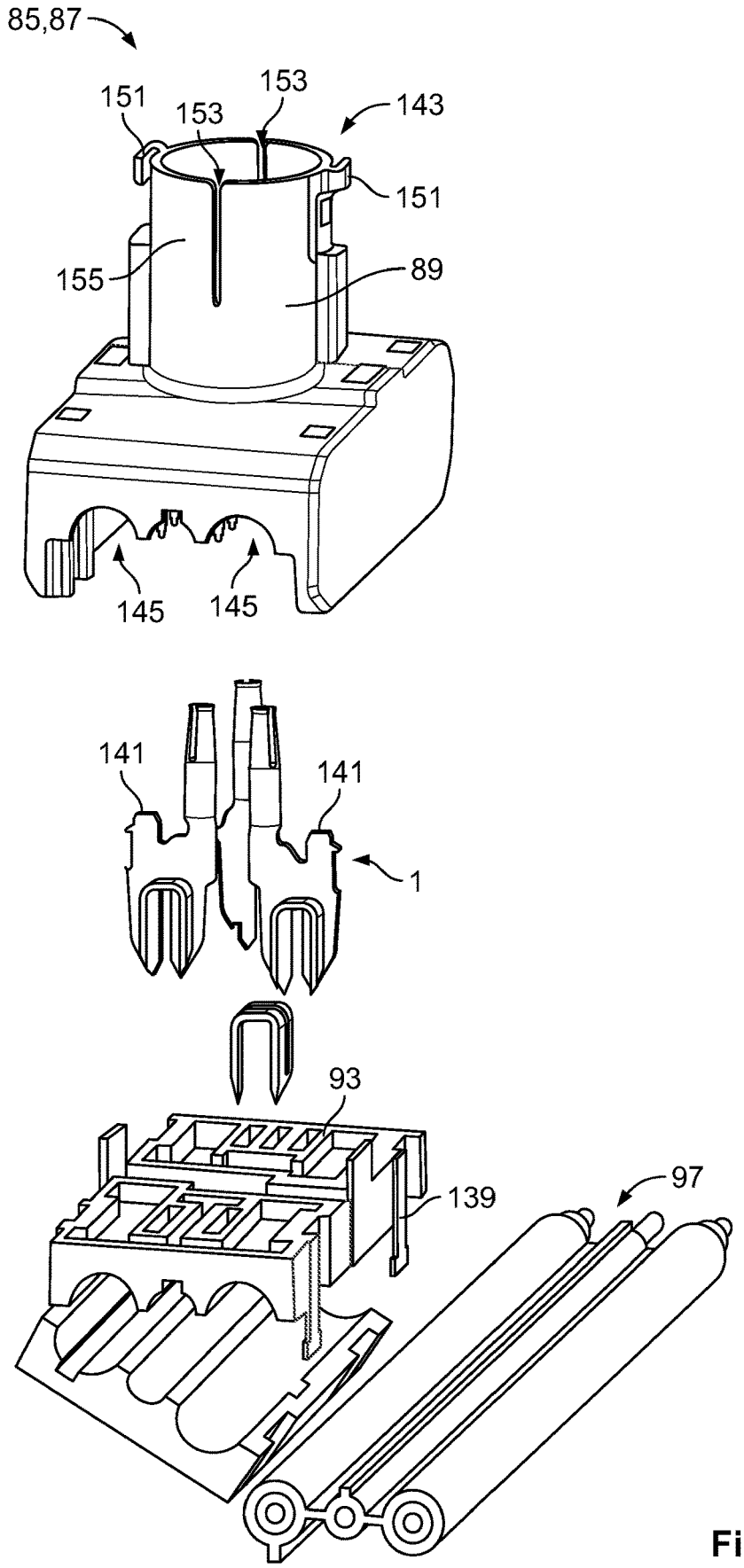
FIG. 11 is an exploded perspective view of an IDC assembly according to another embodiment.

FIG. 11 shows a further embodiment of the inventive IDC assembly 85 in an exploded view 87. The embodiment of the IDC assembly 85 shown in FIG. 11 differs from the previously shown IDC assembly 85 of FIG. 5 in that different embodiments of the housing 89 and the cable positioner 93 are shown. Further, a different embodiment of the IDCs 1 is also applied in FIG. 11. The only difference between the previously shown IDCs 1 and IDCs 1 shown in FIG. 11 is a stub-shaped contact portion 141. The housing 89 comprises a differently shaped exemplary connector portion 143. The housing 89 further comprises half-circle-shaped cutout portions 145 in which the ribbon cable 97 may be at least partially received. In comparison to the housing 89 of FIG. 5, the housing 89 of FIG. 11 may thus provide an increased stability against displacement of the ribbon cable 97 in a direction perpendicular to their length extension.

As shown in the embodiment of FIG. 11, the cable positioner 93 has locking members 139 by which the cable positioner 93 may be closed (with the ribbon cable 97 received) independently of an insertion of the cable positioner 93 into the housing 89.

Figure 12:
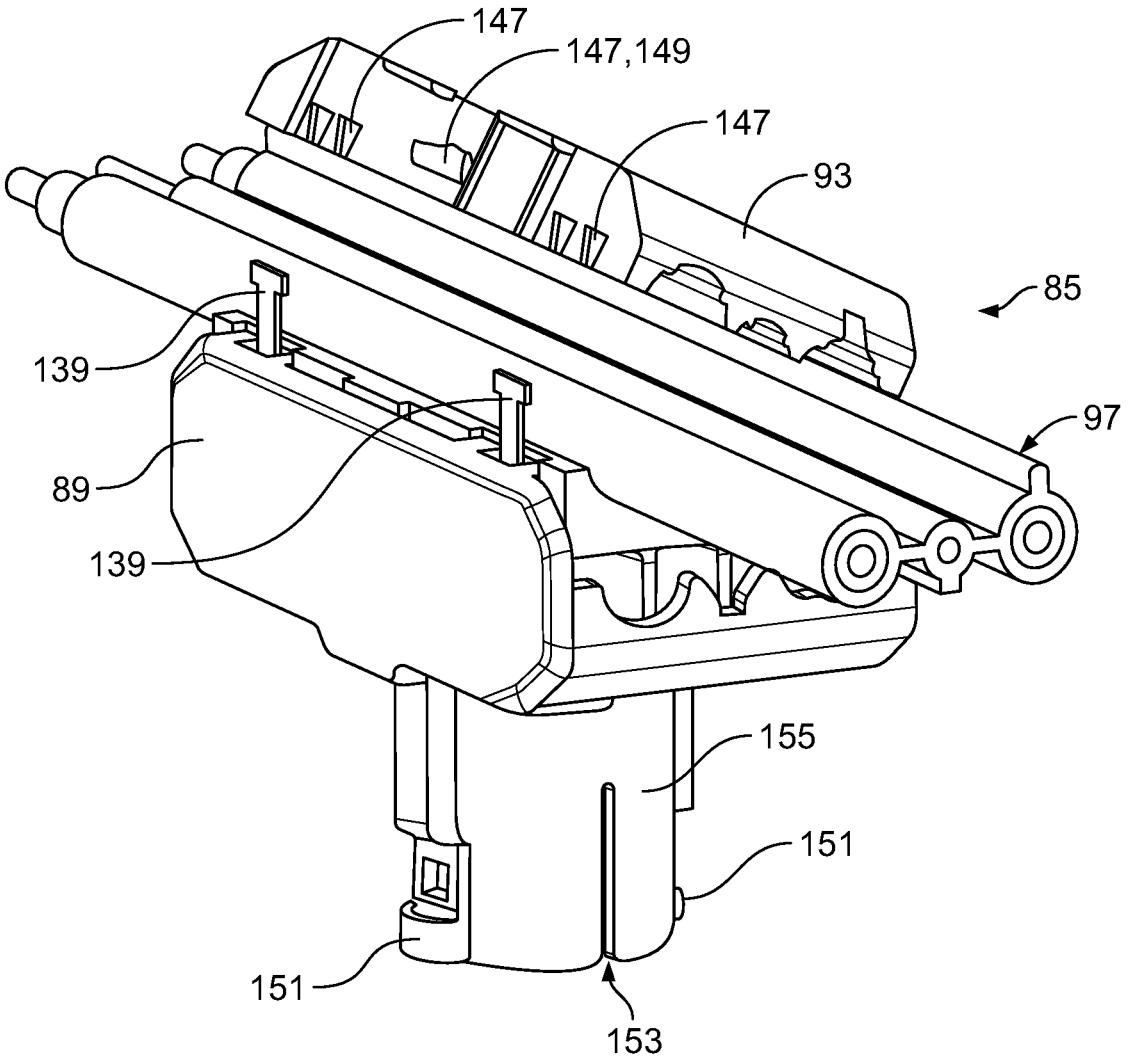
FIG. 12 is a perspective view of the IDC assembly of FIG. 11 in a preassembled state.

In FIG. 12, a different perspective of the IDC assembly 85 of FIG. 11 is shown. As can be seen, the cable positioner 93 may also be received within the housing 89 prior to closing the cable positioner 93 with the locking members 139. Closing the cable positioner 93 and insertion of the cable positioner 93 with the received ribbon cable 97 into the housing 89 may thus be performed in one process step. In FIG. 12, the counter-locking members 147 for closing the cable positioner 93 are visible. The figure also shows a counter-locking member 147 that locks the entire cable positioner 93 within the housing 89. The latter counter-locking member 147 may be referred to as a positioning counter locking member 149.

In FIGS. 11 and 12, the connector portion 143 is provided with bayonet-style locking members 151 and a longitudinal recess 153 which allows for increased flexibility of a tube-shaped connector portion 155 when being connected to a mating connector.

Figure 6:
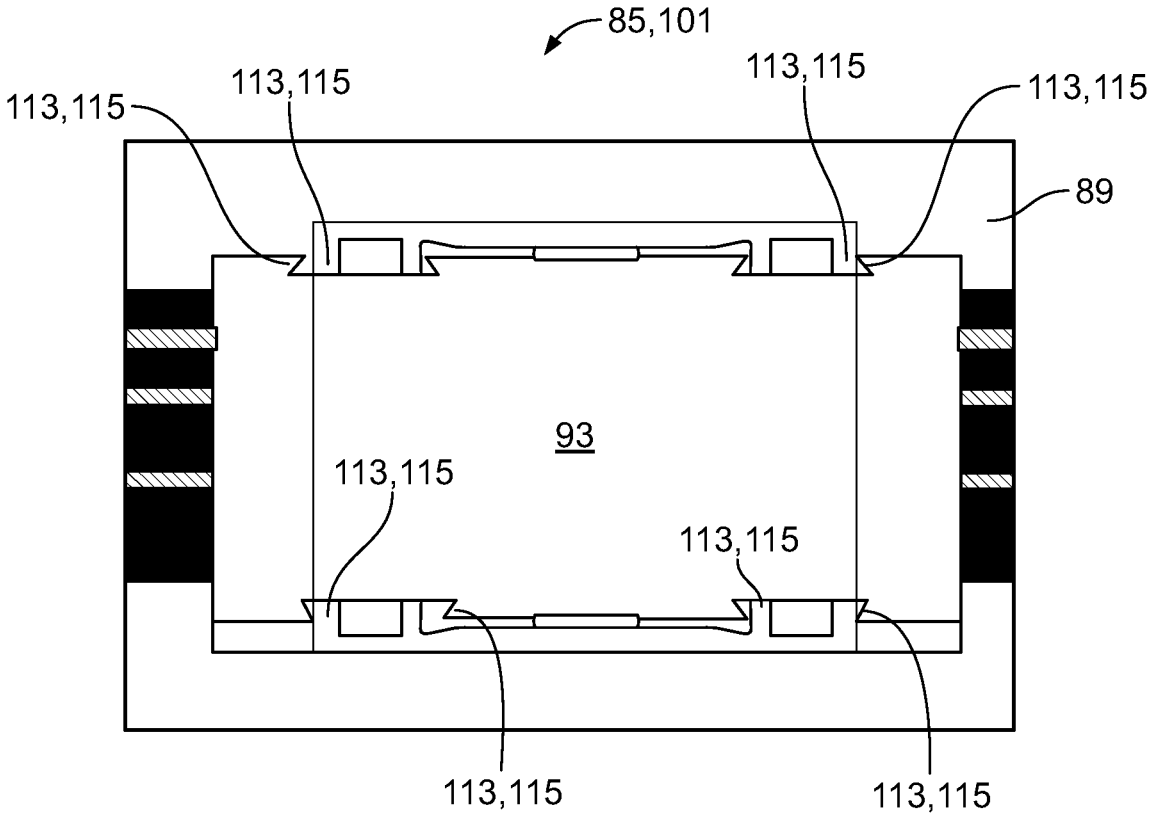
FIG. 6 is a bottom view of the IDC assembly.

In FIG. 6, a bottom view of the IDC assembly 85 clearly shows guiding features 113 which are embodied as dove-tailed guidance members 115. The housing 89 and the cable positioner 93 each comprise four dove-tailed guidance members 115. These dove-tailed guidance members 115 are advantageous for providing stable guidance for high-performance IDC assemblies 85.

Figure 7A:
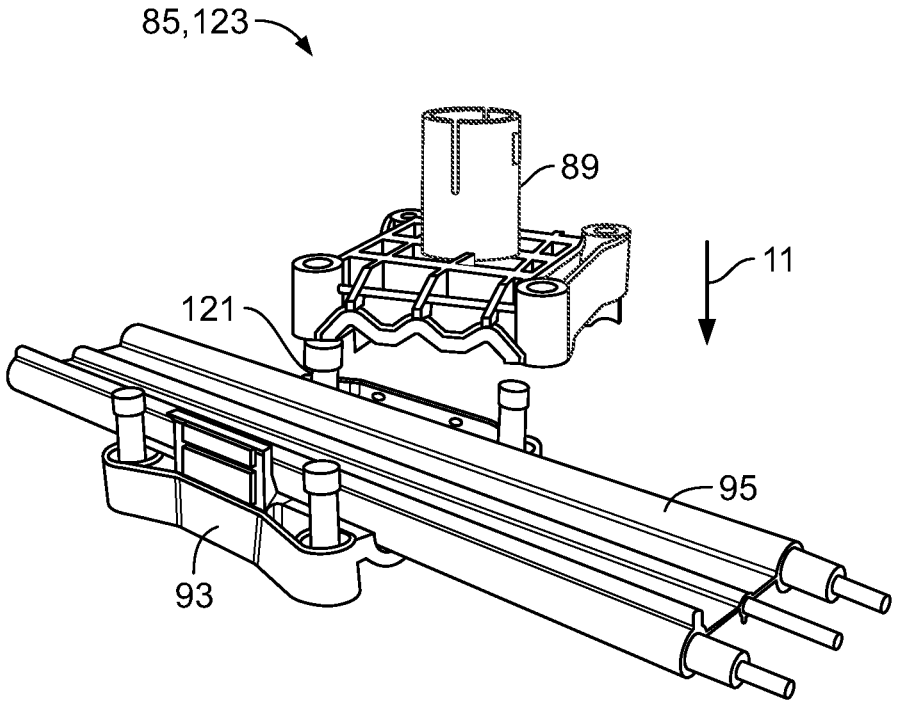
FIG. 7A is a perspective view of a first step of contacting a multitude of wires with an IDC assembly according to another embodiment.
Figure 7B:
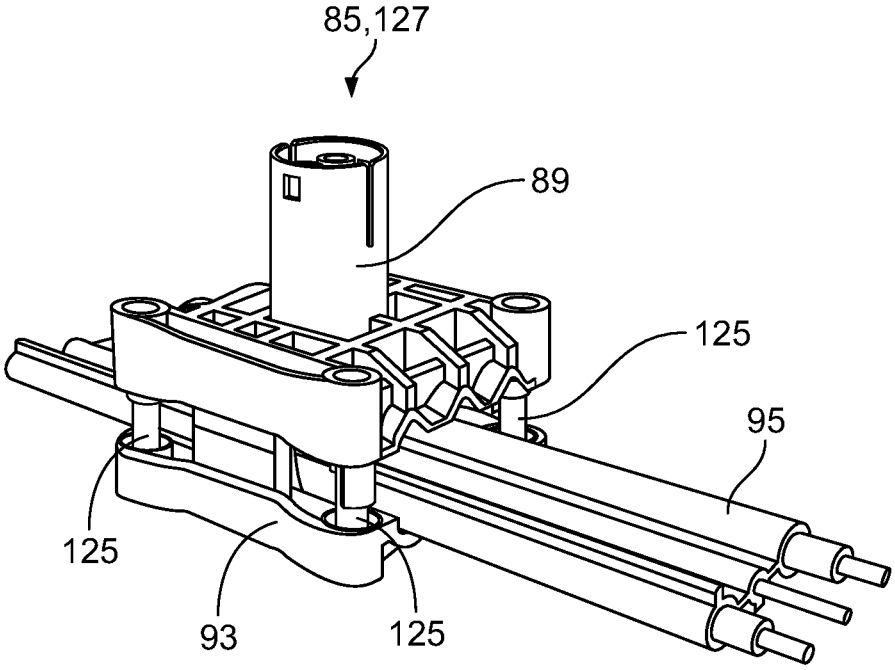
FIG. 7B is a perspective view of a second step of contacting the multitude of wires with the IDC assembly of FIG. 7A.
Figure 7C:
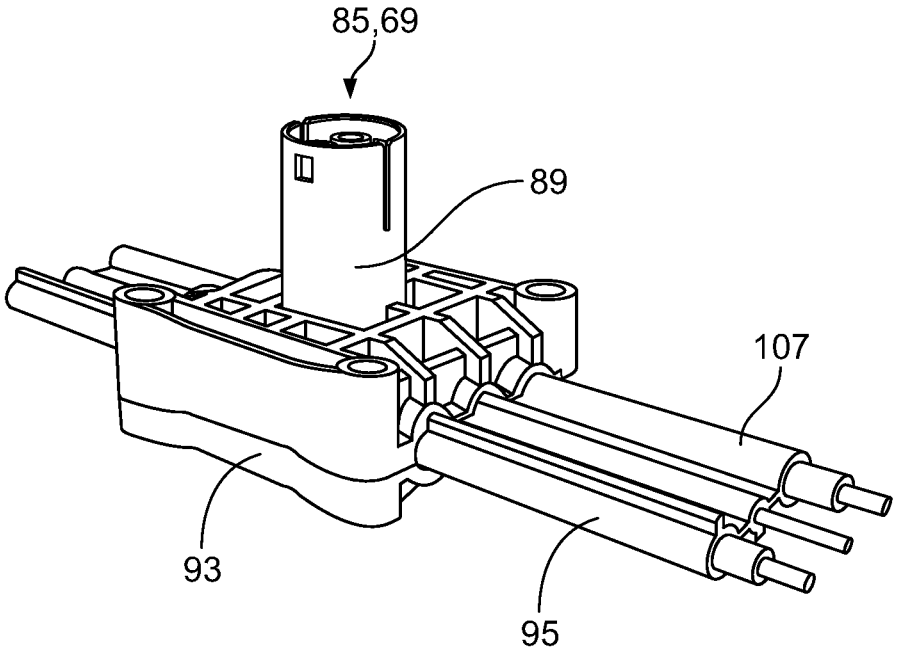
FIG. 7C is a perspective view of a final step of contacting the multitude of wires with the IDC assembly of FIG. 7A.

FIGS. 7*a* to 7*c* show a second embodiment of the IDC assembly 85. In a preassembled state 123 shown in FIG. 7*a*, the housing 89 is rotatably supported at a rotation pin 121, and the further cables or wires 95 are received within a monolithic cable positioner 93 which opens in a direction counter to the piercing direction 11. Subsequently, the housing 89 is rotated above the cable positioner 93 and brought into abutment with positioning pins 125 of the cable positioner 93. In this second preassembled state 127, the IDCs 1 are positioned above the corresponding further cable or wire 95, as shown in FIG. 7*b*. In FIG. 7*c*, the assembled state 69 is obtained by pressing the housing 89 against the cable positioner 93, thereby cutting through the insulation 107 of the further cables or wires 95 and contacting the corresponding cores 109.

Figure 8A:
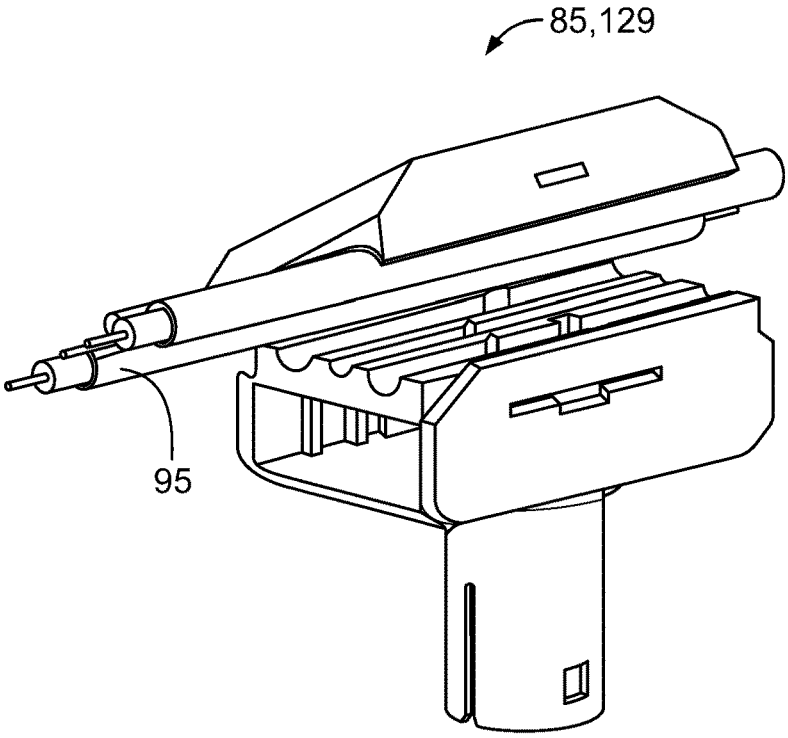
FIG. 8A is a perspective view of an IDC assembly according to another embodiment.
Figure 8B:
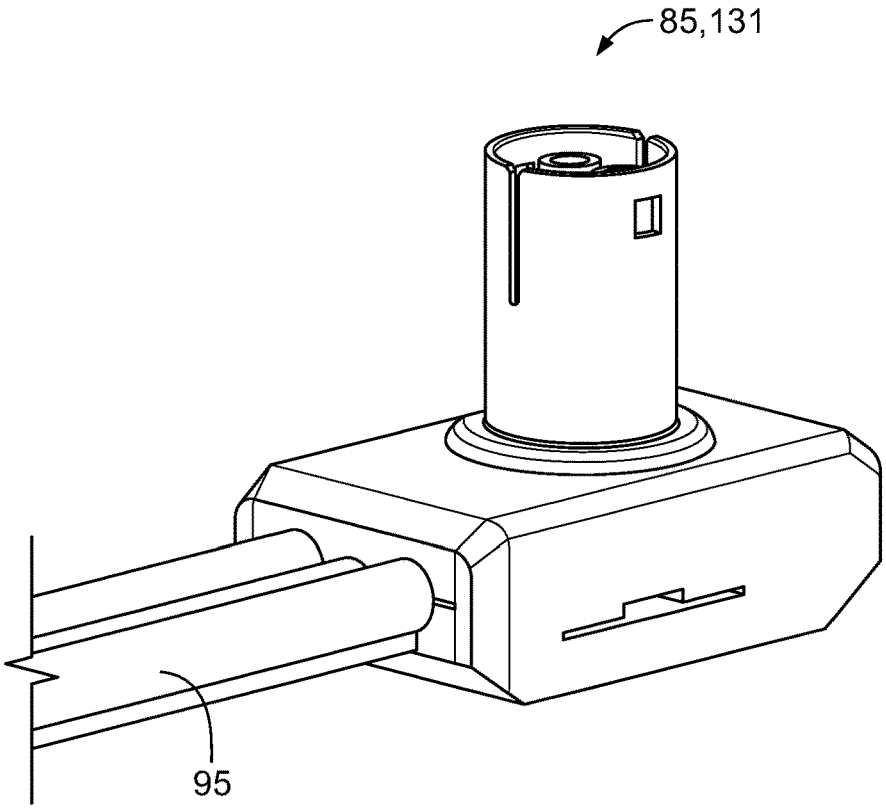
FIG. 8B is a perspective view of an IDC assembly according to another embodiment.
Figure 8C:
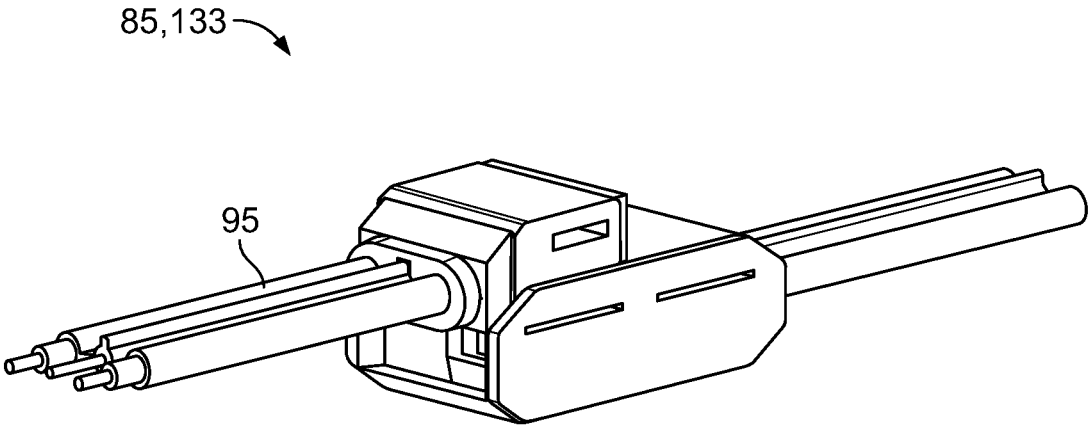
FIG. 8C is a perspective view of an IDC assembly according to another embodiment.

In FIGS. 8*a* to 8*c*, different configurations of the inventive IDC assembly 85 are shown. In FIG. 8*a*, the IDC assembly 85 is a busbar in-line connector 129, which feeds through electrical current. FIG. 8*b* shows a busbar end-line connector 131, which terminates the further cables or wires 95. FIG. 8*c* shows a splice in-line connector 133.

Figure 13:
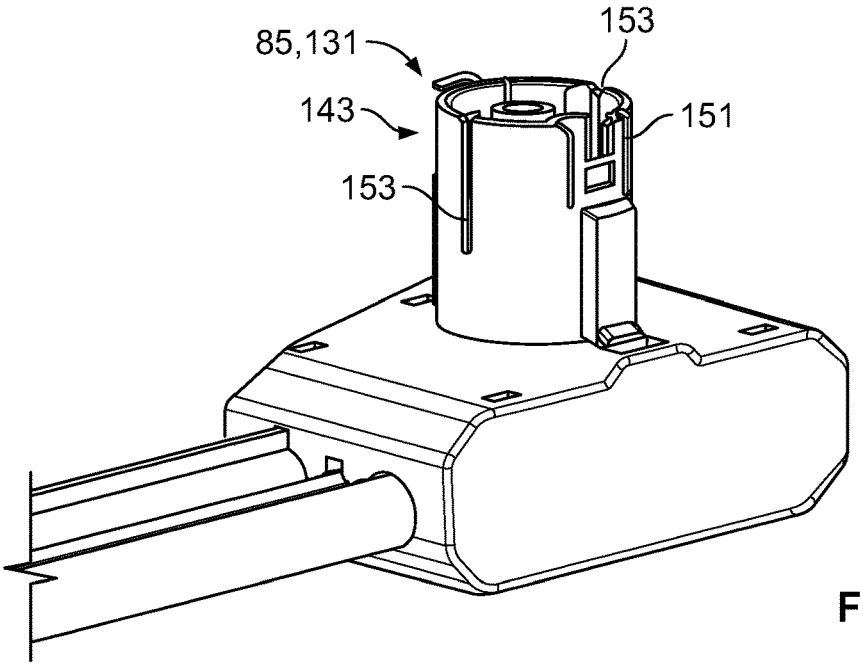
FIG. 13 is a perspective view of an IDC assembly according to another embodiment.
Figure 14:
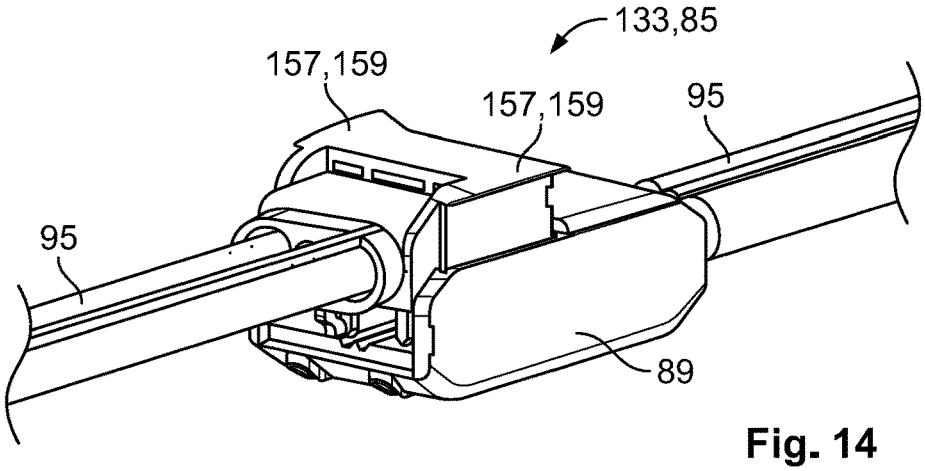
FIG. 14 is a perspective view of an IDC assembly according to another embodiment.
Figure 15:
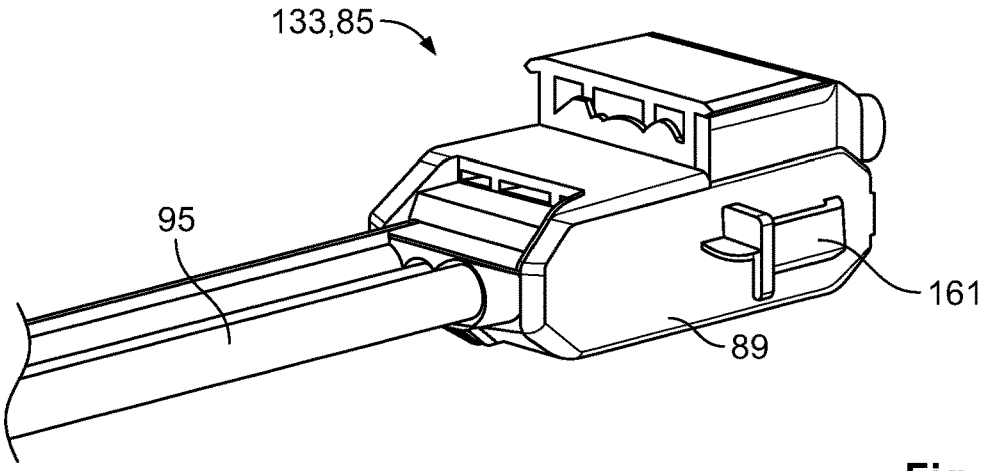
FIG. 15 is a perspective view of an IDC assembly according to another embodiment.

In FIGS. 13-15, further different configurations of the inventive IDC assembly 85 are shown. FIG. 13 shows a different embodiment of the busbar end-line connector 131 that also has a connector portion 143 described in FIG. 11 above. The connector portion 143 of the busbar end-line connector 131 also has the bayonet-style locking members 151 and the longitudinal recesses 153.

In FIGS. 14 and 15, a splice in-line connector 133 is shown with two further cables or wires 95 attached (FIG. 14), respectively with only one further cable or wire 95 (FIG. 15). The splice in-line connector 133 of FIGS. 14 and 15 comprise a housing 89 that differs from the housing shown in FIG. 8*c* as it additionally comprises guiding members 157 that are embodied as overhangs 159. Further, the housing 89 comprises a locking latch 161 that is applied when connecting to a mating connector or a fixing structure.

Figure 9:
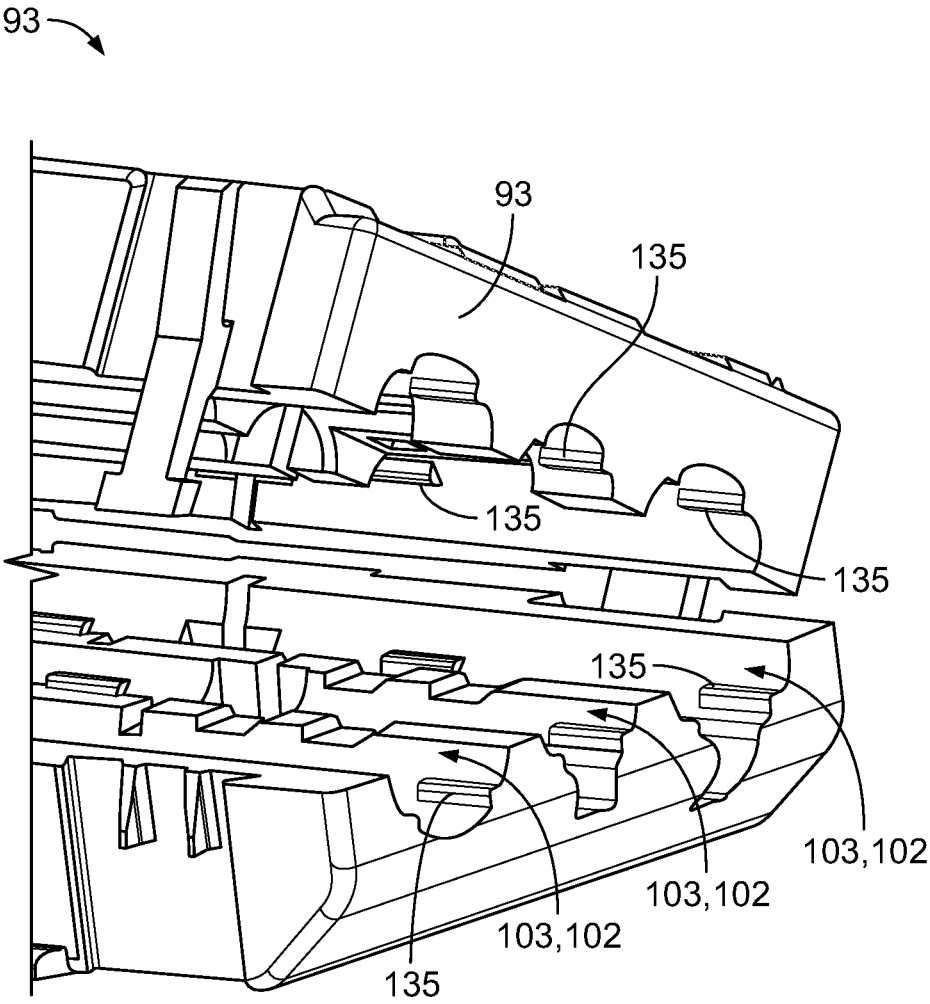
FIG. 9 is a perspective view of a cable positioner.
Figure 10:
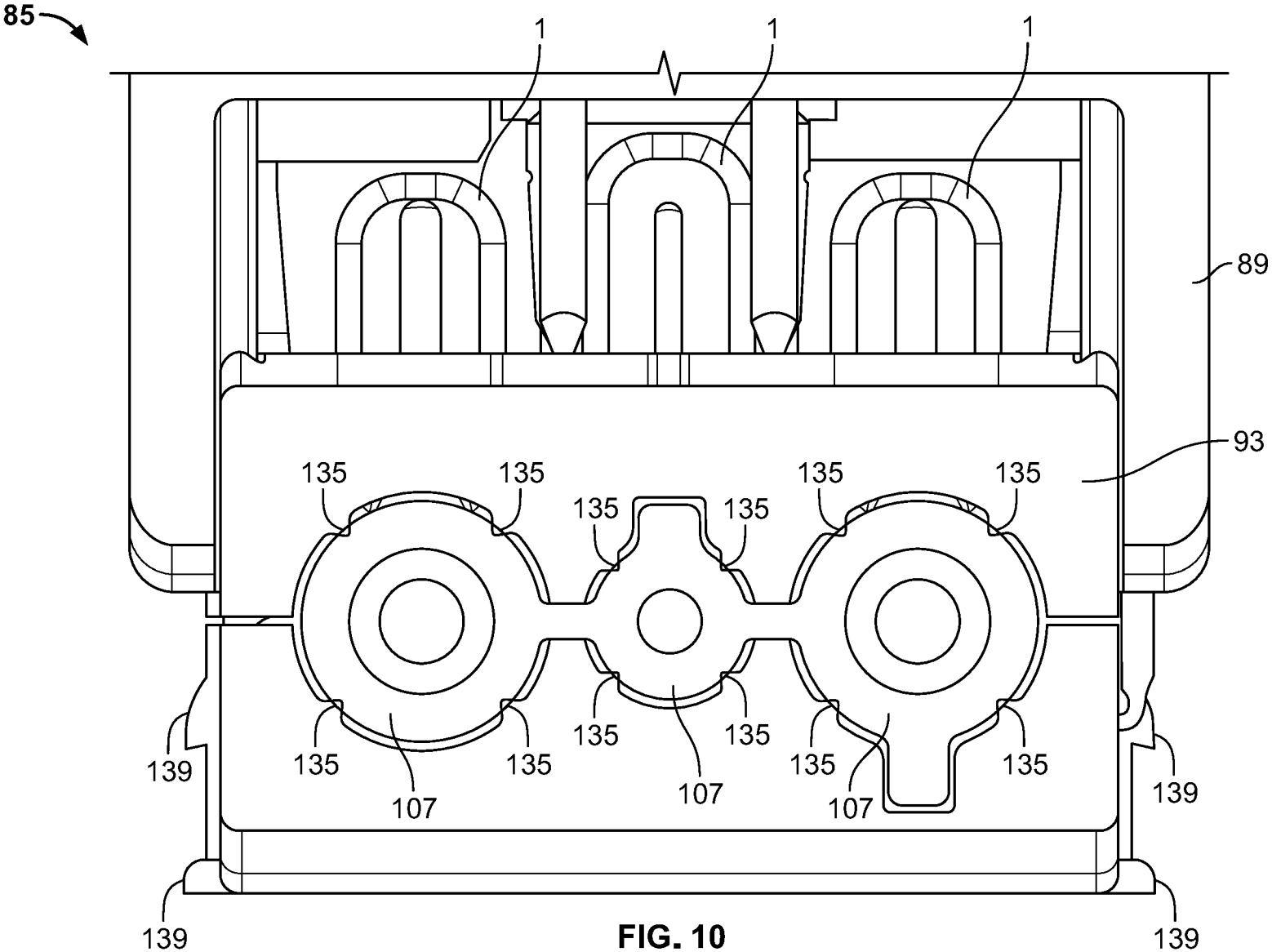
FIG. 10 is a side view of the IDC assembly in a preassembled state.

In FIGS. 9 and 10, strain relief members 135 are shown, the strain relief members 135 being embodied in the cable positioner 93, in particular inside the convex receiving slots 103.

These strain relief members 135 may be understood to constitute protrusions extending into the convex receiving slots 103 and elastically deforming the insulation 107 of the received further cables or wires 95. This is shown in the side view of FIG. 10, in which the IDCs 1 and locking members 139 of the cable positioner 93 are also visible. The strain relief member 135 may have a triangular, pin-like or rectangular shape.

The locking features 139 allow the cable positioner 93 to be locked to the housing 89 in at least two positions. In the first locking position, only the further cables or wires 95 may be received and secured in the cable positioner 93 without coming into contact or being pierced by the IDC 1. Said locking may be reversibly releasable in order to disconnect the core of the further cable or wire 95 from the IDC 1. The second locking position may correspond to the state in which the IDC 1 pierces through the insulation of the further cables or wires 95 and electrically connects the electrically conductive core of the further cable or wire 95. The second position may therefore be understood as an installation position, in which the electrical connection between the core of the further cable or wire 95 and the contact body 7 is established and secured by the locking features 139 holding the cable positioner 93 within the housing 89.

The present invention provides an IDC 1 and IDC assembly 85 with a stable and reliable electrical connection which can be maintained over time even in harsh environments. The attachment slots 39 may increase the flexibility of the blades 37 in a direction away from the contact slot 25, such that even a vibrating core 109 of the cable or wire 95 may be electrically contacted in a reliable manner.

The clip 3 may, in particular, provide stability for the electrical connection with the wire or cable 91, in particular by improving (increasing) the force F in the contact slot 25, the force F being exerted by the contact body 7 of the IDC 1 onto the electrically conductive core 109 of the cable or wire 91. Furthermore, the clip 3 may increase the flexibility of the contact slot 25, i.e. enable the core 109 of a cable or wire 91 to be pressed into the contact slot 25, whereby the contact slot 25 itself may reversibly and elastically be deflected such that its open width is temporarily increased. One of the functions of the clip 3 may be to increase the strength of the contact. Furthermore, the resilience of the clip 3 may sustain the electrical connection between the core 109 of the cable or wire 91 and the IDC 1 even in a harsh, e.g. vibrating, environment.

In particular for high-performance set-ups, i.e. when high currents need to be transmitted via the IDC 1, the cables or wires 91 may be scaled accordingly. Said high-performance cables and wires 91 are less flexible than cables and wires 91 for data transmission, and therefore have specific requirements with respect to the stability of the mechanical connection between the housing 89 and the cable positioner 93. The inventive IDC 1 and the inventive IDC assembly 85 may be applied for all cuttable insulations known in the art, e.g. in the case of double-insulated cables or wires 19.

What is claimed is:

1. An insulation displacement contact for piercing through an insulation of a cable or wire in a cutting direction and electrically contacting an electrically conductive core of the cable or wire, comprising:

a contact body having a piercing section for piercing the insulation and a contact slot receiving the core of the cable or wire, the contact slot extending along the cutting direction from the piercing section into the contact body, the contact body having a pair of blades separated by the contact slot, the blades have a pair of attachment slots extending from the piercing section into the blades; and a clip insertable into the attachment slots.

2. The insulation displacement contact of claim 1, wherein the attachment slots extend parallel to the contact slot.

3. The insulation displacement contact of claim 1, wherein the clip has a U-shape.

4. The insulation displacement contact of claim 1, wherein the clip has a mounting slot, at least a portion of the mounting slot is perpendicular to the cutting direction when the clip is attached to the contact body in an attached state.

5. The insulation displacement contact of claim 4, wherein the mounting slot surrounds the contact slot in the attached state.

6. The insulation displacement contact of claim 4, wherein the clip has a clip base and a pair of clip legs extending from the clip base.

7. The insulation displacement contact of claim 6, wherein a pair of ends of the clip legs each have an attachment section inserted in one of the attachment slots in the attached state.

8. The insulation displacement contact of claim 7, wherein the attachment sections extend along the cutting direction to the mounting slot.

9. The insulation displacement contact of claim 4, wherein a pair of opposite walls of the mounting slot are each supported by a face of one of the blades.

10. The insulation displacement contact of claim 1, wherein the contact body extends beyond the clip in a direction perpendicular to the cutting direction and in a direction counter to the cutting direction when the clip is in the attached state.

11. The insulation displacement contact of claim 6, wherein the clip legs are convexly curved away from the contact slot.

12. An insulation displacement contact assembly, comprising:

a housing receiving a cable or wire;

an insulation displacement contact received in the housing, the insulation displacement contact including a contact body having a piercing section for piercing an insulation of the cable or wire in a cutting direction and a contact slot receiving a core of the cable or wire, the contact slot extending along the cutting direction from the piercing section into the contact body, the contact body having a pair of blades separated by the contact slot, the blades have a pair of attachment slots extending from the piercing section into the blades; and a cable positioner receiving and positioning a further cable or wire, the cable positioner has a pair of receiving parts connected to each other by a hinge member, the receiving parts are lockable to each other and the cable positioner is movable into the housing, the insulation displacement contact electrically contacts the further cable or wire received in the cable positioner.

13. The insulation displacement contact assembly of claim 12, wherein the housing and the cable positioner each have a dove-tailed guidance member and a movement of the cable positioner with respect to the housing is guided by the dove-tailed guidance members.

14. The insulation displacement contact assembly of claim 12, wherein the cable positioner is lockable in the housing in at least two positions.

15. The insulation displacement contact assembly of claim 12, wherein a cable receptacle of the cable positioner has a strain relief member extending into the cable receptacle and relieving a strain on the further cable or wire.

* * * * *